United States Patent [19]

Huai-Chieh

[11] 4,443,780

[45] Apr. 17, 1984

[54] FUSE SWITCH WITH PLURAL POSITIONABLE FUSE ELEMENTS

[76] Inventor: Hsu Huai-Chieh, No. 44, La. 53, Ku Shan 1st Rd., Kaohsiung, Taiwan

[21] Appl. No.: 138,443

[22] Filed: Apr. 8, 1980

[51] Int. Cl.[3] ..... H01H 85/22; H01H 85/32

[52] U.S. Cl. ..... 337/257; 337/194; 337/266; 337/206

[58] Field of Search ..... 337/257, 258, 259, 266, 337/2, 5, 10, 186, 206, 284, 194, 289, 290, 412

[56] References Cited

U.S. PATENT DOCUMENTS

| | | | |
|---|---|---|---|
| 1,484,443 | 2/1924 | Weiler | 337/257 X |
| 2,863,966 | 12/1958 | Greber | 337/290 X |
| 3,161,748 | 12/1964 | Linton | 337/257 X |

FOREIGN PATENT DOCUMENTS

| | | | |
|---|---|---|---|
| 398539 | 10/1924 | Fed. Rep. of Germany | 337/258 |
| 191566 | 1/1923 | United Kingdom | 337/257 |

*Primary Examiner*—Stafford D. Schreyer
*Attorney, Agent, or Firm*—Holman & Stern

[57] ABSTRACT

A fuse switch includes a fuse element having a plurality of radiating arms, each arm being positioned, in its turn, above circuit contacts in the switch. The fuse is mounted for rotation, and is controlled by a rachet wheel drive mechanism to change its position. An indication lamp is provided to show when the circuit is broken and to light the switch to indicate the need to repair the fuse when the fuse is burned down due to overload of the circuits. To change the fuse, one merely pushes a drive link so that a pawl of the link drives the rachet wheel, and thus the radiating fuse to rotate another pair of fuse radiating arms into position thereby continuing the power supply. At the same time, the indication lamp is shut off.

5 Claims, 18 Drawing Figures

FUSE SWITCH WITH PLURAL POSITIONABLE FUSE ELEMENTS

BRIEF SUMMARY OF THE INVENTION

The present invention relates to an improved fuse switch including a rachet wheel rotated to a desired angle by a drive bar or link mounted pawl. The switch also includes a fuse having eight or more radiating arms, the fuse being controlled by the rachet wheel to change the fuse position when one pair of opposing arms has burned through. The switch of the invention is also provided with an indication lamp connected in parallel with the power and controlled by means of a relay to to provide light for the operator to repair the fuse when the fuse has burned down due to overload of equipment on the circuit.

OBJECTS OF THE INVENTION

One object of the present invention is to facilitate assembly and disassembly of a fuse switch without the use of a screwdriver.

Another object of the invention is to provide means carried by a switch, as for example a rachet wheel, for changing an internally carried fuse, to thus save repair time.

Yet another object of the invention is to provide a fuse switch with an indication lamp so that repair during operation at night can be made without providing additional lighting equipment.

BRIEF DESCRIPTION OF THE SEVERAL VIEWS OF THE DRAWINGS

The present invention will now be described in greater clarity and specificity with reference to the following drawings in which.

DESCRIPTION OF THE PREFERRED EMBODIMENTS

Figure 1:
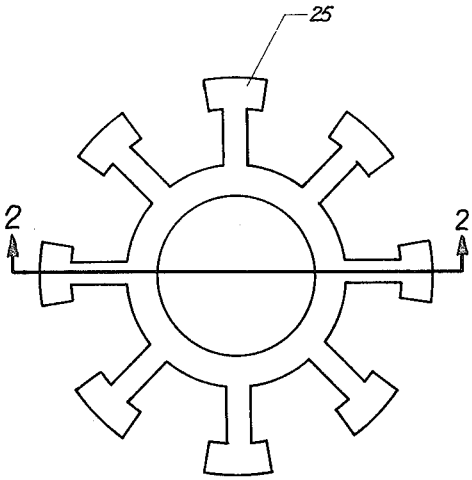
FIG. 1 is a top plan view of a preferred fuse element of the present invention.

As shown in the drawings, the present invention comprises a bottom section or cover 1, rotating stand 2, top cover 3, and rachet wheel 33.

Figure 16:
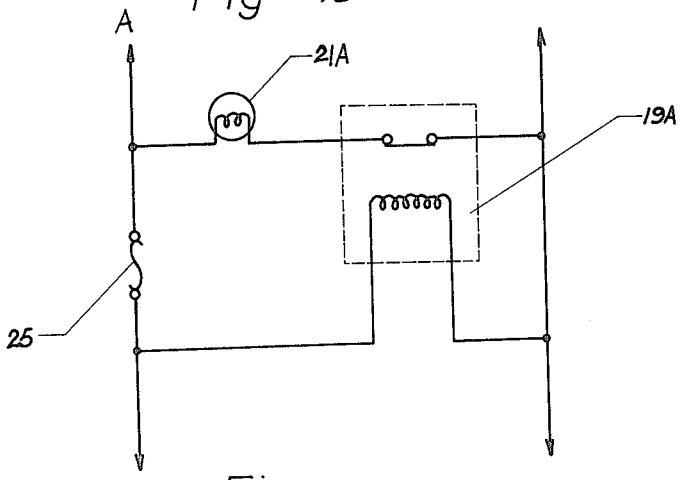
FIG. 16 is a schematic of the circuit of the switch of the present invention.
Figure 17:
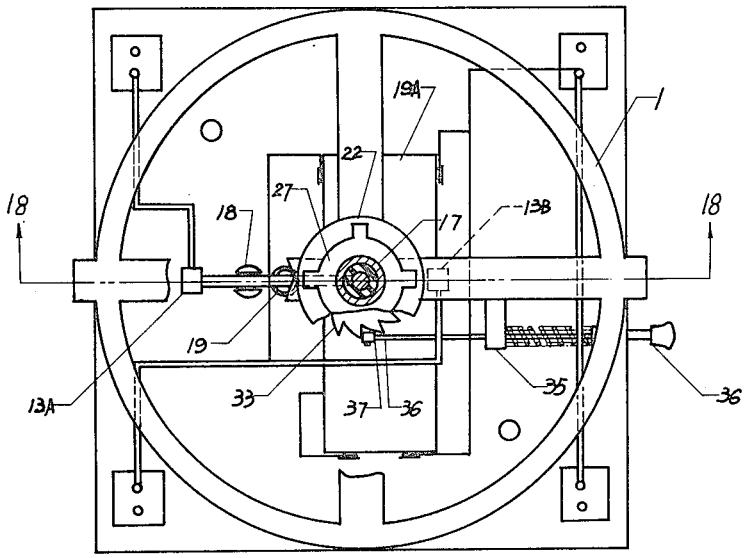
FIG. 17 is a bottom view of the present invention after being assembled.
Figure 18:
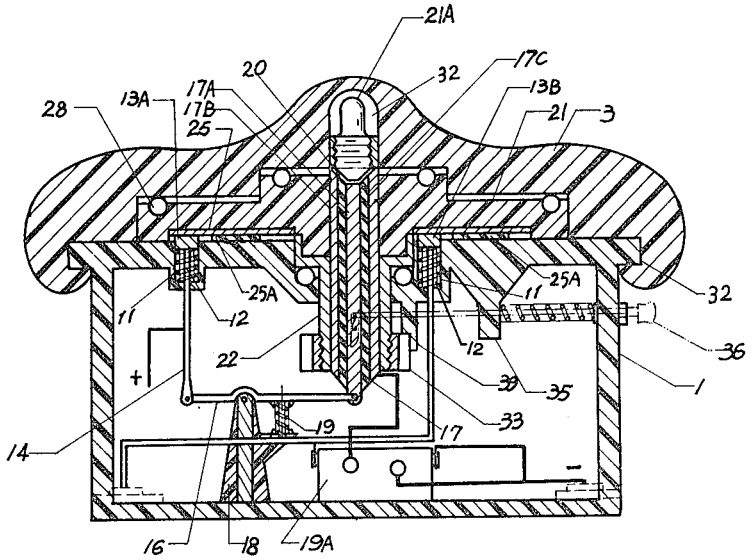
FIG. 18 is a cross-sectional view on section line 18—18 of FIG. 17.

Noting FIG. 18, the bottom section or cover 1 is made of insulating material, and includes a top section or surface having two cavities 11,11 for insertion thereinto of coil springs 12,12 and copper contacts 13A,13B, respectively. The contacts 13A,13B are urged upwardly to a point slightly above the bottom cover surface by coil springs 12,12 in order to maintain tight contact with the fuse 25 when the bottom cover 1 is attached to the top cover 3. Each cavity 11 has an aperture 15 at its bottom to accomodate free movement of vertically disposed copper rod 14 therethrough. Copper rod 14 connects a secondary circuit including a a horizontally disposed bar 16 with a vertically displaceable plunger 17. The middle of the bar 16 is fixed by ordinary means to support bracket 18, with coil spring 19 being positioned between the support bracket 18 and the bar 16 to resiliently urge the end of bar 16 which is connected to plunger 17 upwardly, thus driving plunger 17. Thus contact 13A is urged downwardly so that electric shock is avoided when the fuse is assembled. Contact 13A is connected with a power source by a power cable (see FIG. 16), while contact 13B is connected with equipment powered by the circuit. Plunger 17, located between the two contacts, is connected in parallel with a relay 19A and an indication lamp 21A.

The plunger 17 includes an inner copper conductor 17A, an outer conductive copper cylinder 17B and insulating material 17C separating the inner conductor and the cylinder. At its top end, plunger 17 has a recess 20 for insertion of the bottom of the indication lamp 21A which is fixed within the top cover 3.

Figure 2:
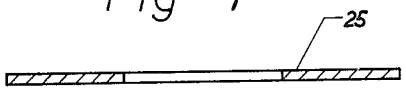
FIG. 2 is a cross-sectional view of the FIG. 1 fuse taken along section line 2—2.
Figure 3:
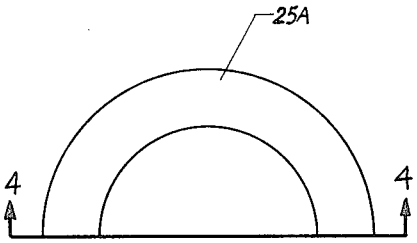
FIG. 3 is a top plan view of the washer of the assembled switch of FIG. 18.
Figure 4:
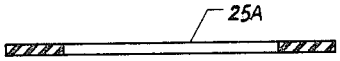
FIG. 4 is a cross-sectional view of the FIG. 3 washer taken along section 4—4.
Figure 5:
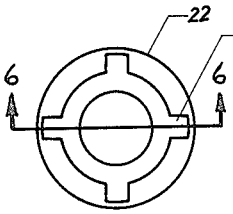
FIG. 5 is a top plan view of the rotating cylinder of the assembled switch of FIG. 18.
Figure 6:
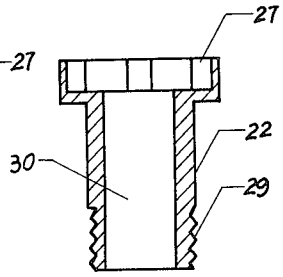
FIG. 6 is a front cross-sectional view of FIG. 5 taken along section line 6—6.
Figure 7:
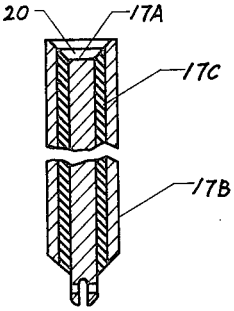
FIG. 7 is a front cross-sectional view of the plunger of FIG. 18.
Figure 7A:
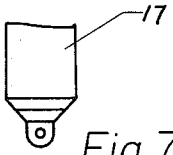
FIG. 7*a* is a partial elevational view of the plunger of FIG. 7 when rotated 90°.
Figure 11:
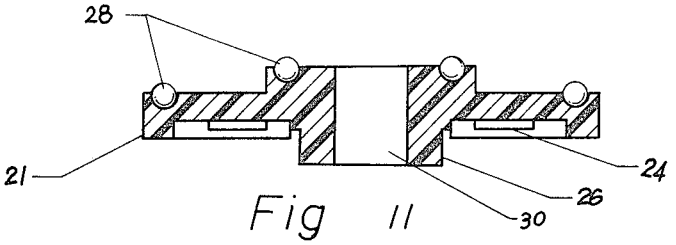
FIG. 11 illustrates, in section, the rotating disc of FIGS. 12 and 17.
Figure 12:
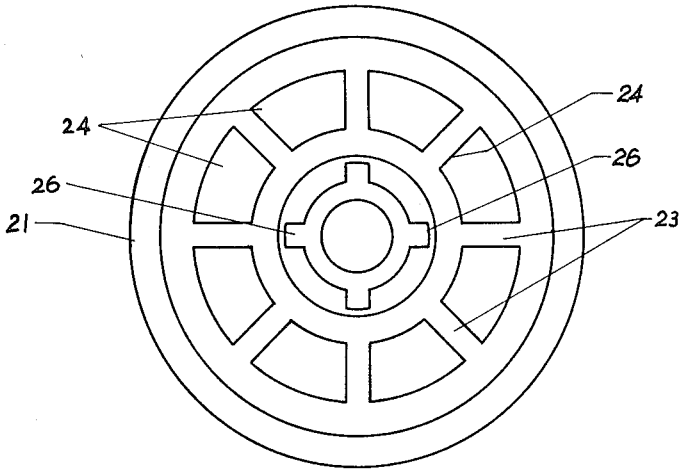
FIG. 12 is a bottom plan view of the rotating disc of FIG. 11.

As can be seen in FIG. 18, the rotating stand 2 comprises the rotating disc 21 and rotating cylinder 22 both coaxial with plunger 17 on which indication lamp 21A is carried. Referring to FIGS. 11 and 12, the rotating disc 21 includes eight apertures or depressions 23 separated by partitions or lands 24. Each depression receives one of the arms of the fuse 25 shown in FIGS. 1 and 2. Thus when the disc 21 is rotated, each arm of the fuse 25 is followed by a respective partition 24. Beneath fuse 25 is a washer 25A provided for the support of the fuse to avoid chipping away thereof as it is burned down. The center of the rotating disc 21 is provided on one side with a cross-shaped key 26 which may be inserted into the cross-shaped keyway 27 in the rotating cylinder 22, and on its other surface is provided with balls 28 to increase the likelihood that disc 21 will rotate uniformly. Rotating cylinder 22 (note FIGS. 5 and 6) includes at one end a cross-shaped keyway 27 for insertion thereinto of the rotating disc key 26, and under that end has external threads 29 for fixing it within the rachet wheel 4. Both rotating disc 21 and rotating cylinder 22 have aligned apertures—the rotating cylinder including aperture 30 extending longitudinally therethrough and preferably being of circular cross-section, and the rotating disc including aperture 30′ extending longitudinally therethrough and also being preferably of circular cross-section—so that free movement of the plunger 17 therethrough may be accomodated.

Figure 13:
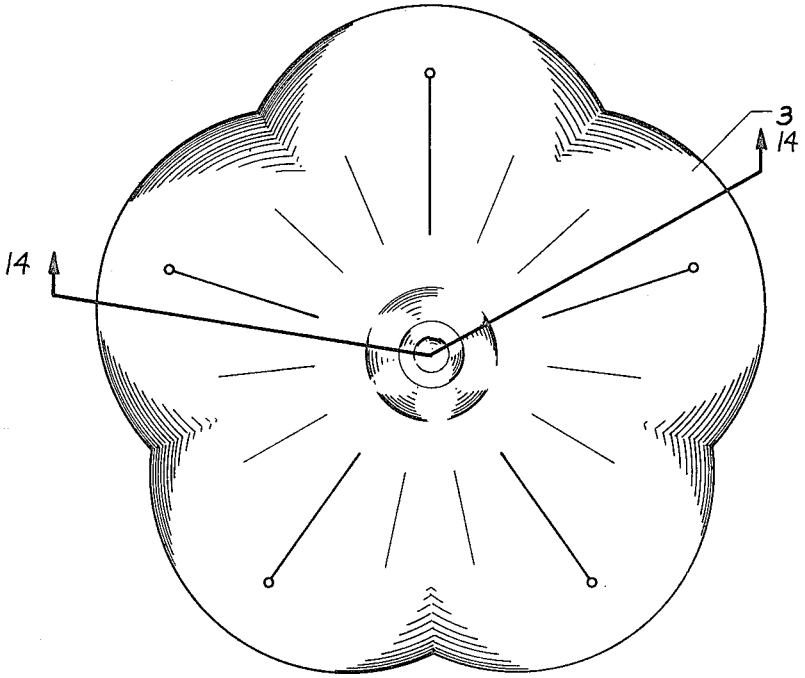
FIG. 13 is a top view of the top section or cover shown in FIG. 18.
Figure 14:
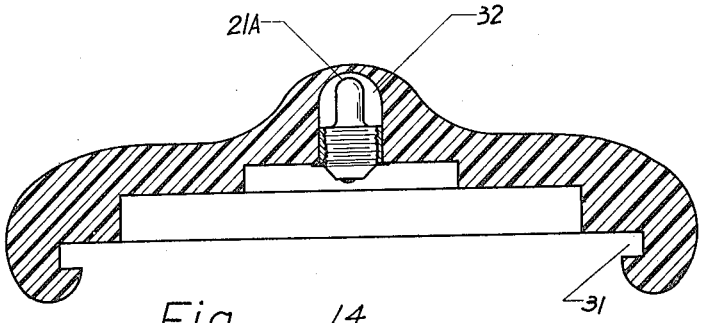
FIG. 14 is a cross-sectional view of the top section cover taken along section line 14—14 in FIG. 13.
Figure 15:
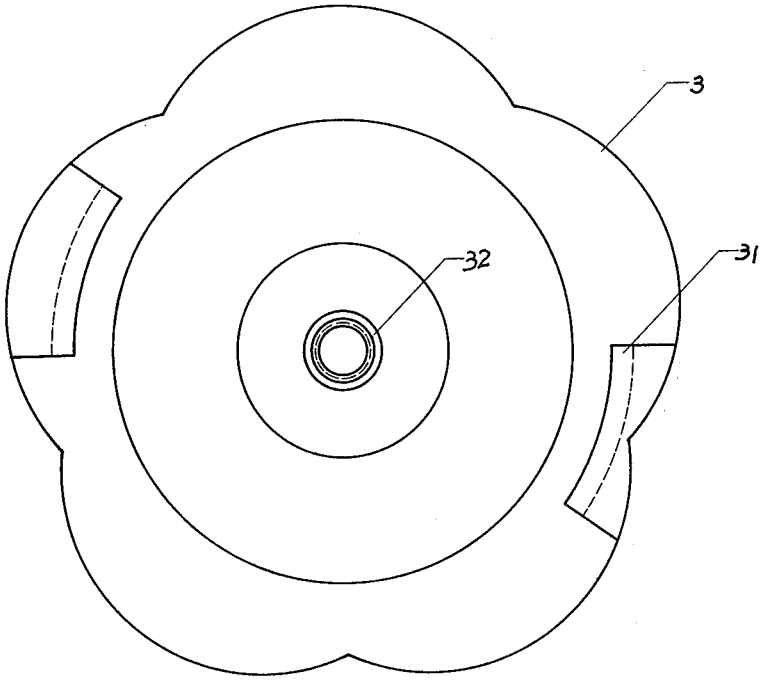
FIG. 15 is a bottom view of the top cover of FIG. 14.

The top cover 3, shown in FIGS. 13, 14 and 15, is made of transparent plastic material, having recess or slot 31 and indication lamp cavity 32 for receipt therein of the indication lamp 21A. Internal and external threads at the cavity 32 and lamp 21A, respectively, permit the lamp to be fixed within the cavity. Top cover 3 is attached to the bottom cover 1 by engaging slot 31 with flange 32, respectively.

Figure 8:
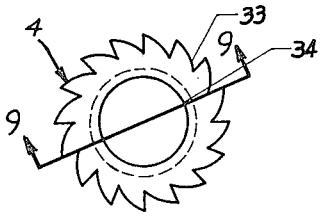
FIG. 8 is a top view of the rachet wheel of FIGS. 17 and 18.
Figure 10:
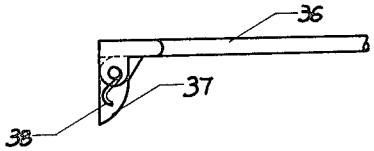
FIG. 10 is a front elevational view of the drive bar or link shown in FIG. 17.
Figure 9:
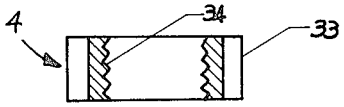
FIG. 9 is a front cross-sectional view of FIG. 8 taken along section line 9—9.

The rachet wheel 4, as shown in FIGS. 8 and 9, includes rachet notches or teeth 33 at its periphery, and an internal thread 34 which engages with the external thread 29 of the rotating cylinder 22 by ordinary means.

Both bottom cover 1 and flange 35 have aligned apertures (see FIG. 18) to accomodate free linear movement of the drive bar 36 therethrough. When the drive bar 36 is moved toward the center of the switch, pawl 37 on the drive bar 36 is caused to move by a spring 38, and to engage a tooth 33 of rachet wheel 4, thus driving the rachet wheel through the desired angle. As this stroke of pawl 37 ends, a retaining pawl 39 (actuated by another spring not shown) swings about fixed pin to engage a convenient tooth to prevent the rachet wheel 4 from turning back when the drive bar 36 returns outwardly from its displaced position (i.e., moves away from the switch center).

We claim:

1. A fuse switch for an electric circuit, the fuse switch comprising:

a power source;

a load driven by said power source;

a housing including separable top and bottom sections, said top section carrying an indication lamp and said bottom section supporting thereon a rotatable platform carrying a primary circuit normally connecting said power source with said load;

a secondary circuit in said housing for connecting said power source with said lamp;

first switching means in said primary circuit comprising a fuse element having fusible portions, at least one of said portions being disposed in said primary circuit for completing said primary circuit, said first switching means defining means for connecting said power source to said secondary circuit when said at least one portion fuses thereby disconnecting said power source from said primary circuit; and means for repositioning said first switching means while in said primary circuit, said repositioning means being cooperable with said platform to reconnect said power source with said primary circuit by disposing another of said fusible portions in said primary circuit thereby disconnecting said power source from said secondary circuit after said at least one portion has fused and said first switching means is repositioned, said repositioning means including means for mechanically driving said platform, the latter carrying said first switching means and being rotatable in response to actuation of said driving means.

2. The fuse switch of claim 1 further comprising:

a plunger supported within said rotatable platform for axial movement, said plunger comprising means for electrically interconnecting said primary circuit with said secondary circuit; and said driving means being manually actuable and supported for linear movement by said bottom section.

3. The fuse switch of claim 2 wherein said plunger comprises outer and center insulated contacts, said center contact being attached at one end of said plunger to said interconnecting means, said center and outer contacts forming at said other end of said plunger a socket for receipt of said lamp;

said primary circuit including at least one axially biased contact; and said interconnecting means comprising pivoted conductive linkage means attached at one end to said plunger one end, and at its other end to said axially biased contact;

whereby when said top section is assembled with said bottom section, said plunger is displaced axially downwardly within said housing and said contact is biased axially upwardly against said first switching means.

4. The fuse switch of claim 3 wherein said linkage means is sectional and is resiliently supported in said bottom section for pivotal movement about its point of support; and said power source is connected to said linkage means between said biased contact and said plunger.

5. The fuse switch of claim 3 wherein said platform carries a ratchet wheel about its periphery; and said driving means comprises at one end pawl means for engaging said ratchet wheel, and at its other end a handle for imparting linear motion thereto, whereby when said driving means is moved linearly, said pawl means engages said ratchet wheel and causes it to rotate thereby effecting rotation of said first switching means.

* * * * *